United States Patent [19]

Nakagawa

[11] 4,114,591

[45] Sep. 19, 1978

[54] EXOTHERMIC METALLIC COMPOSITION

[76] Inventor: Hiroshi Nakagawa, Oeda 89-8-25, Kasukabe-shi, Saitama, Japan

[21] Appl. No.: 757,890

[22] Filed: Jan. 10, 1977

[51] Int. Cl.[2] ..... F24J 1/02

[52] U.S. Cl. ..... 126/263; 44/3 A; 44/3 R; 126/204; 149/37; 149/40; 252/186; 128/254; 128/403

[58] Field of Search ..... 252/186; 149/37, 40; 44/3 A, 3 R; 126/264, 263; 128/254, 403

[56] References Cited

U.S. PATENT DOCUMENTS

| | | | |
|---|---|---|---|
| 1,075,709 | 10/1913 | Goldschmidt | 44/3 |
| 1,760,102 | 5/1930 | Baker | 44/3 A |
| 1,901,313 | 3/1933 | Mann | 126/263 |
| 1,910,874 | 5/1933 | Ziegler et al. | 44/3 A |
| 2,040,407 | 5/1936 | Reed | 126/263 |
| 3,649,390 | 3/1972 | Ahlert et al. | 149/37 |
| 3,874,504 | 4/1975 | Verakas | 128/403 |
| 3,976,049 | 8/1976 | Yamashita et al. | 44/3 A |

*Primary Examiner*—Benjamin R. Padgett
*Assistant Examiner*—Deborah L. Kyle
*Attorney, Agent, or Firm*—Holman & Stern

[57] ABSTRACT

An exothermic metallic composition for a body warmer comprising (1) one or more members selected from the group comprising iron, aluminum and magnesium in the form of fine particle and (2) an oxidation agent comprising one or more members selected from the group comprising ferrosoferric oxide, plumboblumbic oxide, trimanganese tetroxide, black copper oxide and manganese dioxide in the form of fine particle, water and particulate oxidation assistants such as sodium chloride and active carbon.

7 Claims, 1 Drawing Figure

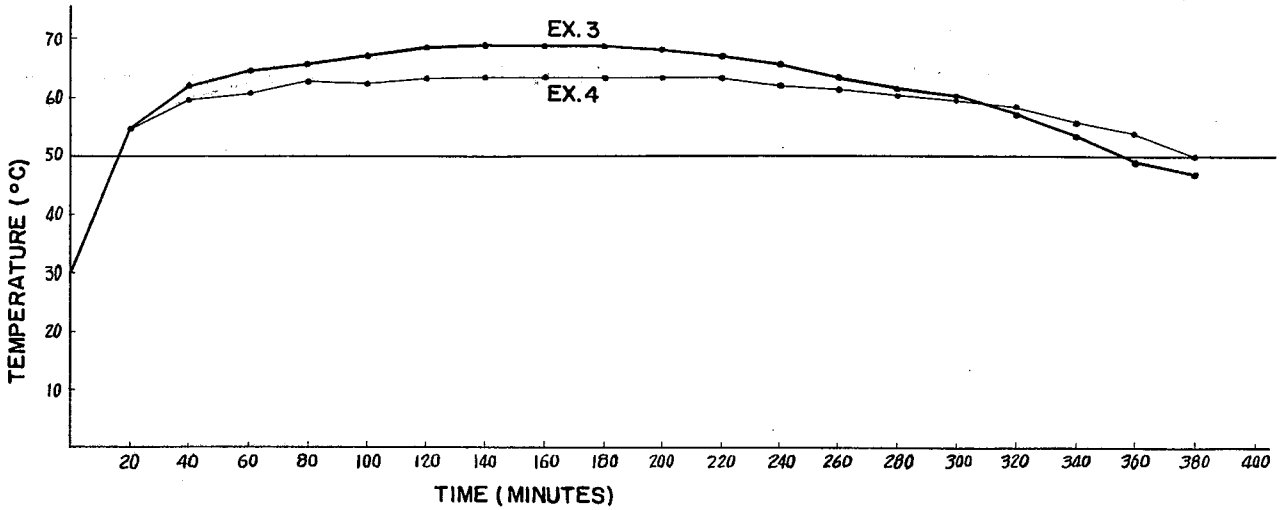
TEMPERATURE (°C)
70
60
50
40
30
20
10
EX. 3
EX. 4
20
40
60
80
100
120
140
160
180
200
220
240
260
280
300
320
340
360
380
400
TIME (MINUTES)

EXOTHERMIC METALLIC COMPOSITION

BACKGROUND OF THE INVENTION

This invention relates to an exothermic metallic composition for a body warmer which comprises at least one of particulate principal metallic components such as iron, aluminum and magnesium; a particulate oxidation agent comprising at least one of ferrosoferric oxide, plumboblumbic oxide, trimanganese tetroxide, black copper oxide and manganese dioxide; water; particulate oxidation assistants in the form of a chloride such as ammonium chloride, calcium chloride or sodium chloride; and active carbon.

SUMMARY OF THE INVENTION

The purpose of the present invention is to provide an exothermic metallic composition for a body warmer which comprises a principal metallic component or components and an oxidation agent including oxidation assistants in a quite simple manner.

In order to attain the purpose, according to the present invention, a predetermined amount of a particulate oxidation agent comprising one or more members selected from the group comprising ferrosoferric oxide, plumboblumbic oxide, trimanganese tetroxide, black copper oxide and manganese dioxide, water and including a predetermined amount of particulate oxidation assistants such as sodium chloride and active carbon is added to one or more particulate principal metallic members selected from the group comprising iron, aluminum and manganese in an amount corresponding to the total amount of the oxidation agent to bring about an exothermic reaction between the principal metallic component or components and the oxidation agent in the body warmer composition.

BRIEF DESCRIPTION OF THE DRAWING

The sole FIGURE of the accompanying drawing is a graph which shows the relationship between the temperature and service life of the exothermic metallic composition for a body warmer after the composition was contained in a porous container in the form of a porous bag to be applied on a portion of a human body.

PREFERRED EMBODIMENTS OF THE INVENTION

The present invention will be now described by way of several examples of oxidation agents of the invention which merely illustrate the best modes presently contemplated for carrying out the invention.

Before explaining the invention, it should be understood that the principal metallic components, oxidation agents and oxidation assistants in these examples of the exothermic metallic compositions have particle sizes within the range 200 - 800 mesh and it should be also understood that in each case, the amount of the principal metallic component or components such as iron, aluminum and/or magnesium to which the oxidation agent including oxidation assistants is added corresponds to the total amount of the oxidation agent including oxidation assistants employed regardless whether one or more of the principal metallic components are employed in preparing the exothermic metallic compositions of the invention.

EXAMPLE 1

Ferrosoferric oxide; 20 - 50 parts by weight

Sodium chloride; 5 - 10 parts by weight
Active carbon; 20 - 50 parts by weight
Water

EXAMPLE 2

Ferrosoferric oxide; 10 - 30 parts by weight
Manganese dioxide; 10 - 30 parts by weight
Sodium chloride; 5 - 10 parts by weight
Active carbon; 20 - 50 parts by weight
Water 20 - 50 parts by weight

EXAMPLE 3

Manganese dioxide; 5 - 30 parts by weight
Black copper oxide; 5 - 30 parts by weight
Sodium chloride; 5 - 10 parts by weight
Active carbon; 20 - 50 parts by weight
Water 20 - 50 parts by weight

EXAMPLE 4

Ferrosoferric oxide; 5 - 30 parts by weight
Manganese dioxide; 5 - 30 parts by weight
Black copper oxide; 5 - 30 parts by weight
Sodium chloride; 5 - 10 parts by weight
Active carbon; 20 - 50 parts by weight
Water; 20 - 50 parts by weight

EXAMPLE 5

In each of Examples 1 through 4, graphite may be employed in the amount of 2 - 10 parts by weight, respectively and in such a case, the amount of the active carbon employed in each of the oxidation agent is reduced by the amount of 10 - 100 parts by weight, respectively, in proportion of the amount of graphite added to the oxidation agent. The addition of graphite to the oxidation agent accelerates heat conduction within the exothermic metallic composition. Thus, the oxidation agent of Example 5 will be as follows;

EXAMPLE 5

Ferrosoferric oxide; 30 parts by weight
Graphite; 5 parts by weight
Sodium chloride; 10 parts by weight
Active carbon; 25 parts by weight
Water; 30 parts by weight

EXAMPLE 6

Manganese dioxide; 5 - 30 parts by weight
Trimanganese tetroxide; 5 - 30 parts by weight
Sodium chloride; 5 - 10 parts by weight
Active carbon; 20 - 50 parts by weight
Water; 20 - 50 parts by weight In each of the examples given hereinabove, sodium chloride may be replaced by ammonium chloride or calcium chloride within the scope of the invention.

When each of the exothermic metallic compositions of the invention referred to hereinabove is employed for its intended purpose, that is, as the composition for a body warmer. A predetermined amount of any one of the various oxidation agents is placed in a container in the form of a consumable bag and the container is sealed. One or more of the principal metallic components referred to hereinabove is placed in a consumable separate container in the same amount as the oxidation agent and the container is sealed. The two containers are maintained in their sealed condition until the principal metallic component or components and oxidation agent are mixed together to provide an exothermic metallic composition for a body warmer. In use, the oxidation agent and principal metallic component or components are taken out of their bags, respectively. Thereafter, the oxidation agent and principal metallic component or components are placed in a porous container in the form of a porous bag which is capable of supplying oxygen present in the open air to the contents of the bag. When the porous bag has a high permeability of air or high oxygen supply capacity, the temperature of the exothermic metallic composition is relatively high, but the service life of the composition is relatively short. On the other hand, when the porous bag has a low permeability of air or low oxygen supply capacity, the temperature of the composition is relatively low, but the service life of the composition is relatively long. It is generally recognized that the suitable temperature range for use as the exothermic metallic composition for a body warmer is 45° - 55° C. In order to attain the temperature range referred to hereinabove, it has been found that the porous bag should have the permeability of air within the range from 80 cc/cm$^2$ per minute to 120 cc/cm$^2$ per minute through a series of permeability of air tests in accordance with the standard test procedure. The porous bag for containing the exothermic metallic composition may be produced from a woven cloth, non-woven cloth, porous synthetic resin sheet, porous film, porous paper and synthetic resin sheet lamination and porous paper and synthetic resin film lamination. The sole figure of the accompanying drawing is a graph which shows the relationship between the temperature and service life (in minutes) of the exothermic metallic compositions for a body warmer produced by the present invention when the compositions were placed in porous paper and synthetic resin film bags having the permeability of air of 120 cc/cm$^2$ per minute.

While several examples of the invention have been described in detail it will be understood that the same are for illustration purpose only and not to be taken as a definition of the invention, reference being had for this purpose to the appended claims.

What is claimed is:

1. A body warmer comprising: an exothermic composition which comprises a principal metallic member selected from the group consisting of iron, aluminum and magnesium in particulate form; and an oxidation agent in an amount stoichiometrically equal to said principal metallic member comprising water of 20 - 50 parts by weight; sodium chloride of 5 - 10 parts by weight; an oxide member selected from the group consisting of ferrosoferric oxide, trimanganese tetraoxide, manganese dioxide and mixtures thereof in particulate form of 10 - 60 parts by weight; and active carbon in particulate form of 20 - 50 parts by weight;

a first container containing said principal metallic member;

a second container containing said oxidation agent; and a porous bag means for containing the mixture of the contents of said first container and said second container, said first and second containers being kept separate and apart from each other until it is desired to mix the contents of the same in said porous bag means.

2. The body warmer as set forth in claim 1, wherein said oxidation agent comprises ferrosoferric oxide of 20 - 50 parts by weight, sodium chloride of 5 - 10 parts by weight, active carbon of 20 - 50 parts by weight and water of 20 - 50 parts by weight.

3. The body warmer as set forth in claim 1, wherein said oxidation agent comprises ferrosoferric oxide of 10 - 30 parts by weight, manganese dioxide of 10 - 30 parts by weight, sodium chloride of 5 - 10 parts by weight, active carbon of 20 - 50 parts by weight and water of 20 - 50 parts by weight.

4. A body warmer comprising: an exothermic composition which comprises a principal metallic member selected from the group consisting of iron, aluminum, and magnesium in particulate form; and a stoichiometrically equivalent amount of an oxidation agent comprising water of 20 - 50 parts by weight; an oxide member comprising manganese dioxide of 5 - 30 parts by weight and black copper oxide of 5 - 30 parts by weight; and active carbon in particulate form of 20 - 50 parts by weight;

a first container containing said principal metallic member;

a second container containing said oxidation agent; and a porous bag means for containing the mixture of the contents of said first container and said second container, said first and second containers being kept separate and apart from each other until it is desired to mix the contents of the same in said porous bag means.

5. A body warmer comprising: an exothermic composition which comprises a principal metallic member selected from the group consisting of iron, aluminum, and magnesium in particulate form; and a stoichiometrically equivalent amount of an oxidation agent comprising water of 20 - 50 parts by weight; sodium chloride of 5 - 10 parts by weight; an oxide member comprising ferrosoferric oxide of 5 - 30 parts by weight, manganese dioxide of 5 - 30 parts by weight and black copper oxide of 5 - 30 parts by weight; and active carbon in particulate form of 20 - 50 parts by weight;

a first container containing said principal metallic member;

a second container containing said oxidation agent; and a porous bag means for containing the mixture of the contents of said first container and said second container, said first and second containers being kept separate and apart from each other until it is desired to mix the contents of the same in said porous bag means.

6. A body warmer comprising: an exothermic composition which comprises a principal metallic member selected from the group consisting of iron, aluminum, and magnesium in particulate form; and a stoichiometrically equivalent amount of an oxidation agent comprising water of 30 parts by weight; sodium chloride of 10 parts by weight; an oxide member comprising ferrosoferric oxide of 30 parts by weight; graphite of 5 parts by weight; and active carbon in particulate form of 25 parts by weight;

a first container containing said principal metallic member;

a second container containing said oxidation agent; and a porous bag means for containing the mixture of the contents of said first container and said second container, said first and second containers being kept separate and apart from each other until it is desired to mix the contents of the same in said porous bag means.

7. The body warmer as set forth in claim 1, wherein said oxidation agent comprises manganese dioxide of 5 - 30 parts by weight, trimanganese tetraoxide of 5 - 30 parts by weight, sodium chloride of 5 - 10 parts by weight, active carbon of 20 - 50 parts by weight and water of 20 50 parts by weight.

* * * * *